United States Patent [19]

Kawai

[11] Patent Number: 4,459,051

[45] Date of Patent: Jul. 10, 1984

[54] MATRIX PRINTER

[75] Inventor: Yasuo Kawai, Shizuoka, Japan

[73] Assignee: Canon Kabushiki Kaisha, Tokyo, Japan

[21] Appl. No.: 392,217

[22] Filed: Jun. 25, 1982

Related U.S. Application Data

[63] Continuation of Ser. No. 175,526, Aug. 5, 1980, abandoned.

[30] Foreign Application Priority Data

Aug. 15, 1979 [JP] Japan ..... 54-103187
Sep. 20, 1979 [JP] Japan ..... 54-121241

[51] Int. Cl.[3] ..... B41J 3/12
[52] U.S. Cl. ..... 400/124; 101/93.05
[58] Field of Search ..... 400/124; 101/93.05

[56] References Cited

U.S. PATENT DOCUMENTS 3,882,985 5/1975 Liles ..... 400/124
4,010,835 3/1977 Martin et al. ..... 400/124
4,086,997 5/1978 Wu ..... 400/124 X

FOREIGN PATENT DOCUMENTS 2535699 3/1977 Fed. Rep. of Germany ..... 400/124

*Primary Examiner*—Paul T. Sewell
*Attorney, Agent, or Firm*—Fitzpatrick, Cella, Harper & Scinto

[57] ABSTRACT

A matrix printer comprises a print head for effecting recording on a recording medium, a print wire provided on the print head, a holding member provided on the printing end side of the print wire and movable relative to the print wire, and control means for moving the holding member.

5 Claims, 10 Drawing Figures

MATRIX PRINTER

This is a continuation of application Ser. No. 175,526, filed Aug. 5, 1980, now abandoned.

BACKGROUND OF THE INVENTION

1. Field of the Invention

This invention relates to a matrix printer.

2. Description of the Prior Art

For example, in a wire matrix type printer which effects dot matrix printing while moving a print head in the column direction, where a dot is further to be formed, for example, between adjacent dot matrices, for the purpose of effectively utilizing printing elements limited in number, it has heretofore been the practice to cause a printed medium to be slightly deviated in the row direction to form a new dot by the same printing element or the shift the entire dot print head by a suitable amount in the row direction to form a new dot by the same printing element. It is a matter of fact that the printing speed of the present-day dot printer, even of low speed, is 100 characters/sec. or higher, and in the ordinary printing stroke, for example, where one character is formed by 5×7 matrices and the inter-character space is formed by an amount corresponding to one dot, the time required for the printing of the same row is 1.6 m sec. or less. For simplicity, this time of 1.6 m sec. is considered to be the least time for continuously driving one printing wire of the dot print head. That is, where printing is continuously effected by the same printing wire at the column positions other than the usual printing columns on one printing row as previously described, whether the printed medium is moved or the dot print head is moved up or down, the wire end must be brought to the next printing column position within the given 1.6 m sec. Both the printed medium and the wire print head have a considerable mass and therefore, great energy is necessary to move any one of them and accordingly, the driving device therefore becomes bulky and this actually means a great inconvenience as compared with the effect of an improved printing quality. To avoid such disadvantage, there has been devised the so-called multipass system wherein, for the formation of one character or symbol, the character-by-character formation as aforementioned (incremental printing) is not effected but only the dot column to be formed at first is effected in the first movement stroke of the print head, whereafter the printing column is shifted or the print head position is changed, and then the dot column to be formed next time, for example, the column which could not be printed in the first stroke, is effected in the second movement stroke of the print head. However, although this system is effective as a line printer, it has drawbacks in that it cannot effect incremental printing and that the printing cannot be confirmed until all the printing stroke for one line is terminated.

SUMMARY OF THE INVENTION

It is an object of the present invention to eliminate the above-noted disadvantages and to provide a matrix printer which effectively utilizes matrix printing elements limited in number to thereby improve the quality of printing, can also effect incremental printing, and is simple in construction and inexpensive.

It is another object of the present invention to provide a print head of a wire dot printer which can effect incremental printing and can further insert a dot between the dots of the conventional dot matrix without the above-noted disadvantages and without increasing the number of printing elements.

It is still another object of the present invention to provide a wire matrix printer in which a wire print head is fixed onto a carriage and dot matrix printing is effected while the carriage is moved in the column direction and wherein the wire of the wire print head is movable in a plane perpendicular or substantially perpendicular to the direction of the axis of the printing end of the wire and is provided on the wire print head body and a part or whole of energy supply means for driving it is provided on the carriage.

It is yet still another object of the present invention to provide a matrix printer in which a print head is fixed to a carriage and the printing end side guide of the wire of the print head is slightly movable in a plane substantially perpendicular to the direction of the wire at this portion and means for slightly moving the guide in said plane is provided on the print head itself.

It is a further object of the present invention to provide a matrix printer in which a part or whole of the wire printing end bearing portion movable relative to the structure of the wire print head is provided on the carriage.

It is a further object of the present invention to provide a wire dot print head in which a wire dot print head structure having a printing wire is fixed to a carriage and which effects dot matrix printing while moving the carriage in the column direction and wherein the printing end side guide of the printing wire is slightly movable in a plane substantially perpendicular to the direction of the wire in the portion of said guide and means for slightly moving the guide in said plane is provided on the wire dot print head structure.

Other objects of the present invention will become apparent from the following detailed description of some embodiments of the invention taken in conjunction with the accompanying drawings.

DESCRIPTION OF THE PREFERRED EMBODIMENTS

Figure 1:
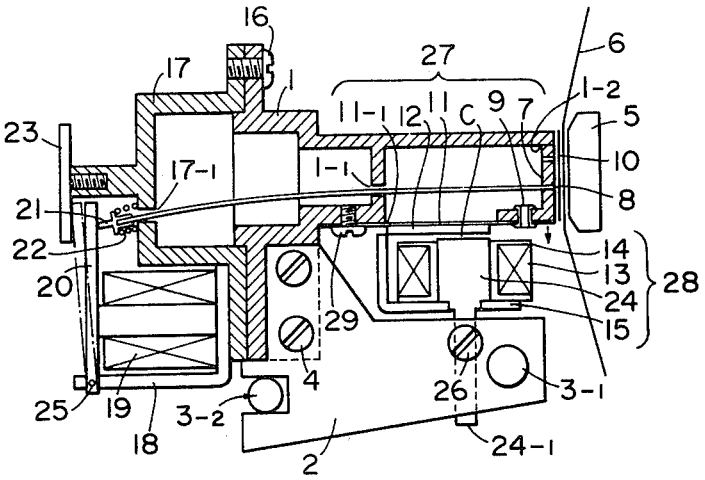
FIG. 1 is a cross-sectional view, taken in the row direction, of an embodiment of the wire print head portion to which the present invention is applied.

FIG. 1 shows an example of the construction in which, for simplicity, both the direction of movement of the wire printing end bearing portion and the direction of arrangement of the printing wires are the row direction and two column movement positions can be selected and energy supply means using an electromagnet is provided on a carriage. This Figure shows a portion of a cross-section of the neighborhood of the wire print head of a wire dot printer taken in the row direction and for convenience, only one wire is shown and only a portion of the wire energizing electromagnet and the portion thereof engaged with the wire is disclosed. However, the direction of arrangement of the printing wires may also be other than the row direction and the arrangement may also be zigzag. Further, the direction of movement of the wire printing end bearing portion is restricted to lie in a plane perpendicular or substantially perpendicular to the direction of the wire axis at the printing end of the wires, but it may be in any direction within this range and more than two movement positions may be selected and, of course, a part or the whole of the wire printing end movable bearing portion may be provided on the carriage.

The printer shown in FIG. 1 has a print head body frame 1 which is secured to the carriage 2 by means of screws 4, and the carriage 2 is guided for movement in the column direction by two guide shafts 3-1 and 3-2. The wire printing end movable bearing portion 27 is attached to the print head body frame 1 by means of a screw 29. The print head body frame 1 is provided with a wire intermediate guide aperture 1-1 and a stopper surface 1-2 which supports the intermediate portion of a printing wire or head 8 and determines the normal stationary position of a wire printing end bearing 7. The rearward portion of the printing wire 8 is guided by a guide aperture 17-1 provided in a subframe 17, and the subframe 17 and a bracket 18 to which a printing wire driving electromagnet 19 is attached are secured to the print head body frame 1 by means of screws 16. The armature 20 of the printing wire driving electromagnet 19 is supported for pivotal movement about a pin 25 with respect to the bracket 18 so that the printing head 8 can be moved back and forth, and the retracted position (indicated by dots-and-dash line) of the printing wire 8 is determined by an armature stopper 23. A cap 21 is secured to the rear end of the printing wire 8, and a spring 22 for biasing the printing wire 8 in the retracted direction is provided between the cap 21 and the subframe 17. The wire printing end movable bearing portion 27 comprises a plate spring 11 having a bend fulcrum 11-1 fixed by a screw 29, and the wire printing end bearing 7 and armature 12 are secured thereto. The energy supply means to the armature 12 comprises an electromagnet device 28 which in turn is constituted by a pole piece 24, a bobbin 14 secured to the pole piece, an electric winding 13 wound on the bobbin, and a yoke 15, and a pole piece shaft 24-1 integrally extending from the pole piece 24 is engaged with an engaging aperture provided in the carriage 2 and is fixed by a screw 26. With the current to the electric winding 13 cut off, the plate spring 11 is biased so that the upper end of the wire printing end bearing 7 is stationarily urged against a stopper surface 1-2 extending from the print head body frame 1. When current is supplied to the electric winding 13, the armature 12 is attracted to the pole piece while being slightly pivoted about the neighborhood of the bend fulcrum 11-1 against the resilient force of the plate spring. Accordingly, the wire printing end bearing 7 is moved in the direction of arrow and the printing wire 8 engaged with the wire printing end bearing 7 is also moved in a direction substantially perpendicular to the direction of the axis thereof (the direction of arrow in the drawing). If the clearance C through which the armature 12 and the pole piece 24 are opposed to each other is selected to a suitable value and the pole piece shaft 24-1 is fixed to the carriage 2 by the screw 26, the amount of movement of the printing wire 8 at the fore end portion of the wire can be determined. An ink ribbon 10 is disposed just in front of the printing end portion of the printing wire 8, a printed medium 6 is disposed behind the ink ribbon, and a platen 5 is disposed behind the printed medium.

Figure 2:
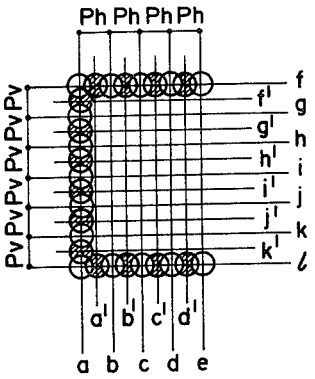
FIGS. 2 and 3 show examples of the symbol printing effected by the use of the wire print head shown in FIG. 1.
Figure 3:
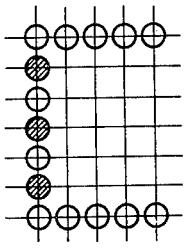

An example of the print obtained by the use of the print head shown in FIG. 1 is shown in FIG. 2. FIG. 2 will now be described by citing FIG. 1. In FIG. 2, f, g, . . . , l are usual column direction printing pitch line having a pitch $P_v$, and f', g', . . . , k' show printing pitch lines newly provided between the column direction printing pitch lines by the action of the wire printing end movable bearing portion 27 and electromagnet device 28 shown in FIG. 1. Also, a, b, . . . , e are usual row direction printing pitch lines having a pitch Ph, and a', b', . . . , d' are printing pitch lines newly provided between the column direction printing pitch lines by further subdividing the amount of feed of the carriage 2 shown in FIG. 1. When the printing wire 8 is positioned on the line a, all of the electromagnets 19 for the printing wire are momentarily energized (seven lines in FIG. 2) to effect the printing of the white circular portions on the line a, and next, when the winding 13 is energized to operate the electromagnet device 28 with the carriage 2 remaining stationary, the printing wire 8 moves to the point of intersection between the line a and the lines f', g'-k'. At this time, if the magnet 19 for the printing wire is again momentarily energized to print the hatching portion on the line a and subsequently the winding 13 is deenergized, the printing wire 8 will return to its original position (the point of intersection between the line a and the lines f, g-l), thus completing the row printing on the line a. In the ensuing printing stroke, only usual column direction printing (on the lines f, g-l) takes place and therefore, the electromagnet device 28 need not be operated, but only the electromagnets 19 for the printing wire which are to print the lines f and l are energized to effect the printing while only the carriage 2 is intermittently moved in the order to a'→b→b' . . . →l, thereby completing a symbol "⊏". FIG. 3 shows an example of the printing of the symbol "⊏" accomplished by using the print head as shown in FIG. 1 and four printing wires constituting 5×7 matrix print, and the dots indicated by hatching have been printed with the operation of the wire printing end movable bearing portion 27 and electromagnet device 28 shown in FIG. 1.

Figure 4:
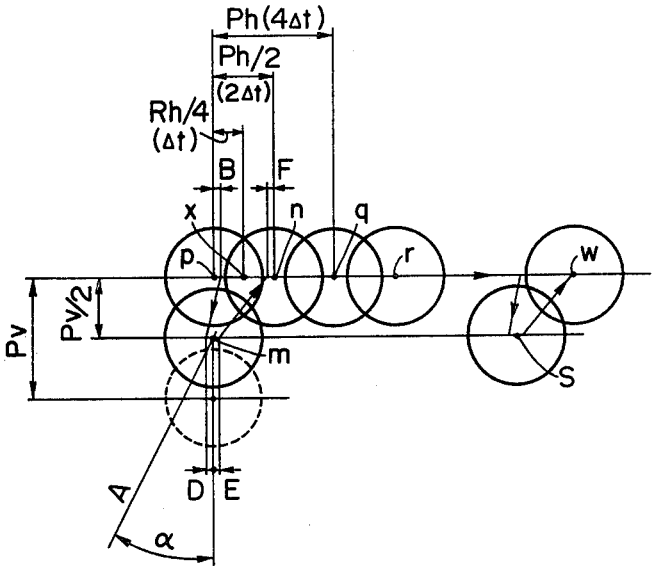
FIG. 4 is an enlarged illustration of the dot row printed by the wire print head portion as shown in FIG. 1.
Figure 5:
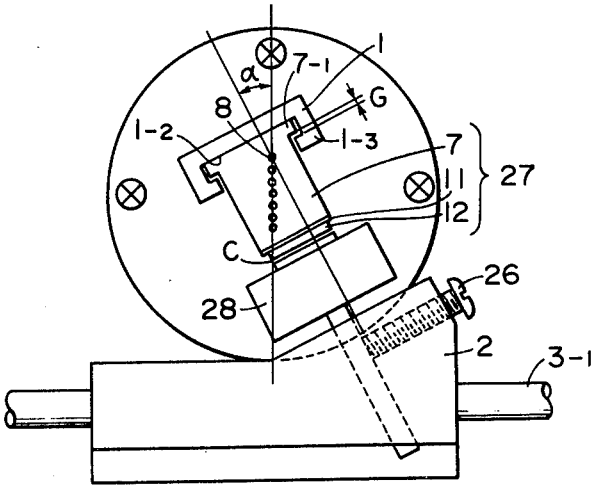
FIG. 5 is a view of another embodiment of the wire print head portion to which the present invention is applied, as seen from the platen side.

In the foregoing description, a case where the wire print head is stationary on the printing row line during the printing has been taken up, but the following example is a case where the wire print head is being moved in the printing column direction during the printing as well. That is, the wire printing end actually strikes the printed medium 6 in the fashion of impacting and the time during which a pressure is applied to the printed medium 6 is very short and within that time, the wire print head is slightly moved in the column direction, but this has little or no practical influence. For simplicity of illustration, FIGS. 4 and 5 show an example of the wire dot print head in which the wire print head is moved at an equal speed parallel to the platen in the column direction and a printing wire in a row of wire arrangement parallel to the printing row direction is movable to two column direction positions, that is, a new intermediate dot can be printed just at the center of the usual dot pitch. The present invention is also applicable to a case where the movement of the wire arrangement comprises a plurality of wires, or a case where the wire arrangement has an inclination with respect to the printing row direction.

In FIG. 4, the dot spots printed by a certain printing wire 8 (for example, the printing wire for printing the most significant column) of the wire print head having the construction as shown in FIG. 1 are indicated by solid-line circles and the dotted circle indicates a dot spot formed by a printing wire adjacent to said certain printing wire in the row direction, for the purpose of supplementing the description. FIG. 5 is a schematic view of the wire print head having printed the dot spots shown in FIG. 4, as seen from the platen side. Description will hereinafter be made with reference to FIGS. 4 and 5.

The time-serial order in which the dot spots have been constructed, if shown at the contral position of each dot spot, is p→m→n→q→r→s→w and the substantial route of the end of the printing wire 8 is indicated by the solid lines combining these and the arrows attached to the solid lines. After Δt seconds from the printing of a point p, the center of the printing wire 8 comes to a point m by the driving of the wire printing end movable bearing portion 27 and effects printing. At this point of time, if the wire printing end movable bearing portion 27 is not driven, the center of the printing wire 8 should come to a point x. The symbol indicated in parentheses under the character indicating the distance in the column direction is the required time. It will be apparent from the condition of equal speed column direction movement of the printing wire 8 that the distance from the origin p at this time (after Δt seconds) is Ph/4. Accordingly, it is necessary that the direction of movement of the printing wire 8 toward a point m lie on a line A combining the point x and the point m. If the angle then formed by the line A with the printing row direction is $\alpha°$, the following equation is established and this angle $\alpha$ becomes the direction of movement of the wire printing end bearing portion 7.

$$\tan\alpha = \frac{Ph}{4} \Big/ \frac{P_v}{2} = Ph/2P_v \tag{1}$$

When, in equation (1), $P_v$=Ph, that is, the printing pitches in the column and the row direction are equal, $$\tan\alpha = Ph/2P_v = \tfrac{1}{2} \therefore \alpha = 26.565°.$$

Also, the distance over which the wire printing end bearing portion 7 should be moved is represented by a segment $\overline{xm}$, which is:

$$\overline{xm} = \sqrt{\left(\frac{Ph}{4}\right)^2 + \left(\frac{P_v}{2}\right)^2} = \sqrt{Ph^2 + 4P_v^2/4} \tag{2}$$

when, in equation (2), $P_v$=Ph as in the previous case, $$\overline{xm} = \sqrt{Ph^2 + 4P_v^2/4} = Ph\sqrt{5}/4 \left(= P_v\sqrt{5}/4\right) \tag{3}$$

For example, if the usual printing pitch is equal both in the column and the row direction and the value thereof is 0.423 mm (1"/60), Ph=$P_v$=0.423 is substituted for equation (3) and thus, the movement distance is $\overline{xm}$=0.237 mm Next, considering in detail the movement of the printing wire 8 during a short time, the printing wire 8 at the point p is moved a distance B in the column direction, whereafter it begins to move toward the point m because the wire printing end movable bearing portion 27 is driven by the current supply to the electromagnet device 28, and comes to the column direction position of the point m at a distance D short of the point m and, when it has reached the point m while holding that position, it effects printing. At a distance E from the point m, the current supply to the electromagnet device 28 is cut off and the wire printing end movable bearing portion 27 begins to return to its original position, so that the printing wire 8 begins to return to a point n and at a distance F from the point n, it returns to the column direction position of the point n and when it has reached the point n, it again effects printing. The reason why the printing wire 8 is caused to come to the print line slightly short of the position whereat it is to print, as described above, is to provide a time allowance for eliminating the pernicious vibration of the printing wire caused by the wire printing end movable bearing portion 27 being driven upon current supply to the electromagnet device 28 and abruptly stopped at the point m. When the current supply to the electromagnet device 28 is cut off, the wire printing end movable bearing portion 27 begins to return to its original position and therefore, it is for the same reason that the printing wire 8 is caused to come onto the print line shortly before it returns toward the point n. The movement of the printing wire 8 from after the printing at the point n till the printing at the point r is the same as that in the conventional wire printer and therefore need not be described. Also, the printing steps at the points s and w would be easily understood from the foregoing description of the printing steps at the points p, m and n and therefore need not be described. In FIG. 5, projected portions 7-1 are provided on the upper portion of the wire printing end bearing 7 and projected portions 1-3 are provided on both sides of the stopper surface 1-2 of the print head body frame 1, whereby when the electromagnet device 28 is deenergized (FIG. 5 shows such state), the upper portion of the wire printing end bearing 7 is urged against the stopper surface 1-2 and when the electromagnet device 28 is maintained energized (not shown), the projected portions 7-1 are urged against the projected portions 1-3, whereby the positioning of the wire printing end bearing 7 is accomplished. With such construction, high accuracy of the clearance G between the projected portions 1-3 and 7-1 can be obtained inexpensively. After an optimal clearance C has been determined, the electromagnet device 28 is fixed to the carriage 2 by means of the screw 26. Of course, it is also possible to secure the electromagnet device to the carriage by other method without using the screw 26 so that the optimal clearance C can be set in advance.

In the above-described embodiment, the wire printing end bearing driving device is constituted by the wire printing end movable bearing portion 27 and the electromagnet device 28 as the energy supply means therefore, and so seen from the embodiment, the wire printing end bearing driving device according to the present invention can be embodied by a simple and inexpensive construction and therefore, various applications such as concentrating at the carriage the place whereat the wire printing end bearing driving device is provided or providing only a part of such driving device on the carriage, as shown in the appended claims, would be readily apparent to those skilled in the art. The effect of providing a wire printing end bearing driving device on a rigid carriage is great because, when a higher printing quality is aimed at as by adding, although not shown in the embodiment, not one dot spot but three dot spots between usual dots, the driving device for operating the wire printing end movable bearing portion 28 as shown in FIG. 1 at high speed and high accuracy unavoidably becomes greater in weight and larger in size due to adoption of a stepping motor or the like. Further, constructing the wire print head itself into a light-weight and inexpensive configuration so that it can also be diverted to various types of printers directed to different purposes would be advantageous in minimizing the manufacturing cost.

In a printer, the weight of the wire print head itself is at least 50 gr and a head having a weight of 100–200 gr and comprising seven to nine wires is common. Of the portions which constitute such print head, the wire printing end bearing portion, if light in weight, is 0.5 gr or less. Also, as regards the required amount of movement of only the bearing portion, if the usual dot pitch is of the order of 0.422 mm (1/60") where a dot is newly provided between usual dots, one half thereof, i.e. 0.21 mm will suffice. If print wires are arranged at a pitch double the usual pitch so that printing of two dot rows is effected by a single wire, 0.42 mm will be the required amount of movement of the bearing. In any case, it is possible by the prior art to move the wire printing end bearing portion by such a degree of amount of movement to a desired column direction position within a short time less than 1.6 m sec., and an electromagnet would first occur to mind as the energy supply means for such movement. A small stepping motor or the like would also occur to mind, although it takes a somewhat longer time. The application form of the present invention is featurized in that of these series of wire printing end bearing portion driving systems, a part or whole of the energy supply means is provided on the carriage. Further, of the aforementioned wire printing end bearing portion driving systems, a part or whole of the movable wire printing end bearing portion may be additionally provided on the carriage.

Another embodiment of the present invention will now be described in detail with reference to the drawings.

Figure 6:
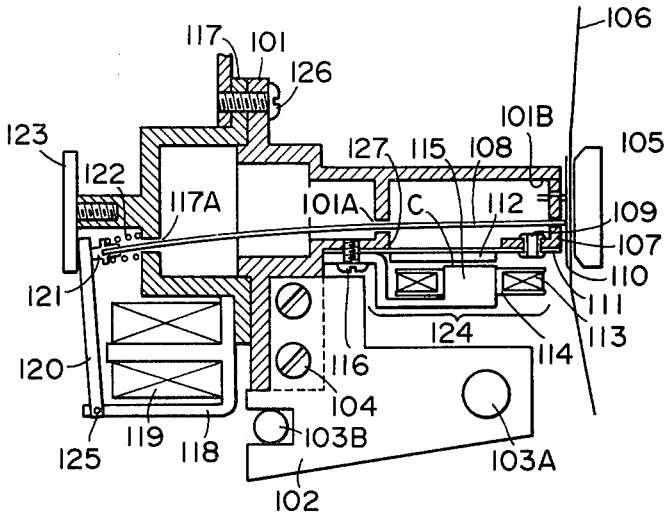
FIG. 6 is a schematic view showing the side and cross-section of an embodiment of the print head according to the present invention.

FIG. 6 shows a cross-section of an embodiment of the print head according to the present invention. In FIG. 6, for the sake of convenience, only one wire is shown and only a portion of the printing wire driving electromagnet and its portion engaging the wire is shown. The printing wires may be arranged in another direction than the row direction or may be arranged in zigzag fashion. The direction of fine movement of the printing end side guide of the wire is restricted within a plane substantially orthogonal to the wire axis direction at the printing end of the wire and in the present embodiment, it is the row direction (the direction of the plane of the drawing sheet), but may sometimes be inclined with respect to the row direction as later described. In the present embodiment, the wire printing position is, in addition to the normal position, only one position during energization of the guide driving electromagnet (intermediate dot inserting position), but more intermediate dot inserting positions may be provided by other means as already described.

In FIG. 6, reference numeral 101 designates a print head body frame, and reference numeral 102 denotes a carriage which may be guided and freely moved in the column direction by two guide shafts 103A and 103B. The print head body frame 101 is fixed to the carriage 102 by means of screws 104. The driving device 124 of the printing end side guide 107 of the wire is attached to the body frame 101 by means of a screw 116. A wire intermediate guide aperture 101A is provided in the print head body frame 101 to support the intermediate portion of the printing wire 108, and a stopper surface 101B which determines the normal position of the printing end side guide 107 of the wire 108 is also provided. The rear portion of the printing wire 108 is guided by a guide aperture 117A provided in a subframe 117. The subframe 117 and a bracket 118 to which a printing wire driving electromagnet 119 is attached are fixed to the body frame 101 by means of a screw 126. The armature 120 of the printing wire driving electromagnet 119 is pivotably mounted on the bracket 118 by means of a pin 125 so that it can push the printing wire 108 to effect printing. A cap 121 is mounted on the rear end of the printing wire 108, and a return spring 122 for retracting the printing wire 108, namely, moving the printing wire away from a printed medium 106, is interposed between the cap 121 and the subframe 117. The printing wire 108 is pushed and retracted by the return spring 122, but when the pivotal movement of an armature 120 comes to be limited by an armature stopper 123, the retraction of the wire 108 is also stopped. The driving device 124 of the printing end side guide 107 of the wire 108 comprises a so-called clapper portion having the guide 107 and armature 112 attached to a plate spring 111 having a bend fulcrum 127, and an electromagnet portion comprising a bobbin 114 having a winding 113 wound thereon and attached to a yoke 115. When no current is supplied to the winding 113, the upper end of the guide 107 is raised by the plate spring 111 and urged against the stopper surface 101B of the body frame 101, and the guide 107 and accordingly, the printing end of the wire 108 is in normal position. When current is supplied to the winding 113, the magnetic attraction acting on the armature 112 becomes stronger than the resilient force of the plate spring 111 and the armature 112 is slightly pivoted in the direction of arrow about the neighborhood of the bend fulcrum 127 and attracted to the yoke 115, and the guide 107 and the printing end of the printing wire 108 engaged with the guide 107 are also slightly moved in a direction substantially perpendicular to the direction of the wire axis, thus assuming an intermediate dot inserting position. The clearance C between the armature 112 and the end face of the yoke 115 is selected to a suitable amount to provide a desired amount of movement of the printing end of the printing wire 108. For that purpose, although not shown, the clearance C may be adjusted. An ink ribbon 110 is positioned just in front of the printing end of the printing wire 108, a printed medium 106 is positioned behind the ink ribbon, and a platen 105 is positioned behind the printed medium. Designated by 109 is an eyelet for attaching the guide 107 to the plate spring 111.

Figure 7:
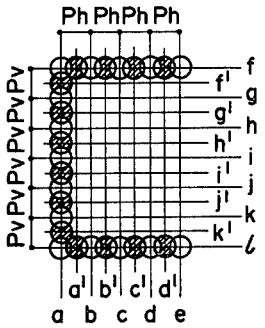
FIGS. 7 and 8 illustrate the forms of printing effected by the print head shown in FIG. 6.

FIG. 7 shows an example of the printing effected by the use of the print head shown in FIG. 6. Here, a–e are usual row direction printing pitch lines, Ph is the pitch thereof, and a′–d′ are row direction printing pitch lines inserted between the printing pitch lines a–e. As previously described, if the impacting period of the printing wire 108 is shorted or the movement speed of the carriage is reduced, dots can be usually inserted into desired intermediate positions. f–l are usual column direction printing pitch lines, $P_v$ is the pitch thereof, and f′–k′ are column direction printing pitch lines inserted between the printing pitch lines f–l according to the present invention. When the printing end of the wire 108 is positioned on the line a, all of the printing wire driving electromagnets 119 are momentarily energized to effect the printing of the white circular portions on the line a and subsequently, when current is supplied to the winding 113 with the carriage 102 remaining stationary and the guide driving device 124 is operated, the printing end of the wire 108 moves to the point of intersection between the line a and the lines f′–k′. If, then, the wire driving electromagnets 119 are momentarily energized again to print the hatching portions on the line a and then the current supply to the winding 113 is stopped, the printing end of the wire 108 returns to its normal position (the point of intersection between the line a and the lines f–l, thus completing the row printing on the line a. In the printing stroke after that, usual row direction printing (on the lines f and l) only takes place and therefore, the guide driving device 124 need not be operated and, if only the wire driving electromagnets 119 for printing the lines f and l are energized to effect printing while the carriage 102 is intermittently moved in the order of a′→b→b′ . . . →l the printing of the symbol as shown in FIG. 7 will be completed.

Figure 8:
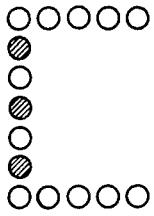

FIG. 8 shows an example of the printing of a symbol similar to that shown in FIG. 7 effected by the use of the print head of another embodiment of the present invention in which four printing wires are arranged in the row direction so as to be capable of 5×7 dot matrix printing, and the dots indicated by hatching are the prints provided by operating the guide driving device 124.

In the example shown above, the carriage 102 has been stationary during the printing. However, in the wire dot printing system, the printing end of the wire actually strikes the printed medium in the fashion of impacting and a pressure acts on the printed medium for a very short time. Even if the carriage 102 is continuously moved in the column direction at an equal speed during this time, there will be little or no influence that the impact print becomes thick in the column direction or becomes blurred, if the time is very short. Of course, it is easier to continuously move a carriage or print head of considerable mass at an equal speed than the move them intermittently. Accordingly, the system whereby the printing is effected with the movement of the carriage continued is preferable. However, if the carriage is continuously moved, the carriage moves during the time from after the wire has effected impact printing at its normal position until an intermediate dot is inserted and so, the direction amount of movement of the printing end side guide of the wire are set by taking into account how much the carriage has been moved during the time from after the wire has effected the printing at its normal position until an intermediate dot is inserted.

Figure 9:
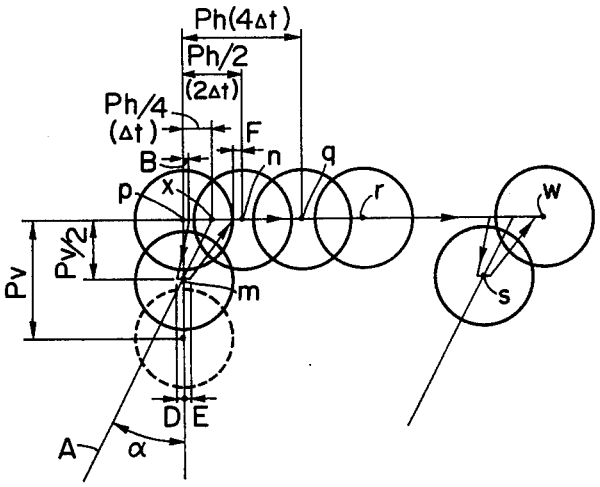
FIG. 9 illustrates the operation when the present invention is embodied in a equal speed moving print head.

FIG. 9 illustrates the printing operation of an example in which the print head is continuously moved parallel to the platen in the column direction at an equal speed and printing wires are arranged in a row in the printing row direction so that a dot can be inserted into the center of the usual dot pitch. Dots printed only by a certain printing wire (for example, one for printing the most significant column) are indicated by, solid-line circles, and a dot printed by an adjacent wire is indicated by broken line. The time-serial order in which the dots have been printed, if shown at the central position of each dot, is p→m→n→g→r→s→w, and the substantial route is indicated by solid lines combining these and arrows attached to these solid lines. After a time Δt of the printing at the point p, the center of the wire 108 comes to the point m by the operation of the driving device 124 of the printing end side guide 107 of the wire 108 to effect printing. If the driving device 124 is not operated at this point of time, the center of the wire 108 comes to the point x. In the parentheses near the character indicating the distance in the column direction, there is shown the time required to come there from the point p. It will be apparent from the condition of the equal speed column direction movement of the printing wire 108 that the point x after the lapse of the time Δt is at a distance Ph/4 from the origin p. Accordingly, the direction of movement of the printing wire 108 toward the point m must lie on a line A passing through the points x and m. If the angle formed by the line A with the printing row direction is $\alpha$, the following equation is established and this angle $\alpha$ becomes the direction of movement of the guide 107.

$$\tan\alpha = \frac{\frac{Ph}{4}}{\frac{P_v}{2}} = \frac{Ph}{2P_v} \tag{1}$$

When, in equation (1), Pv=Ph, that is, the printing pitches in the column and the row direction are equal, $$\tan\alpha = \frac{Ph}{2P_v} = \tfrac{1}{2}$$

$$\therefore \alpha = 26.565^\circ$$

Also, the amount of movement is represented by $\overline{xm}$, which is $$\overline{xm} = \sqrt{\left(\frac{Ph}{4}\right)^2 + \left(\frac{P_v}{2}\right)^2} \leqq \frac{\sqrt{Ph^2 + 4P_v^2}}{4} \tag{2}$$

When, in equation (2), Pv=Ph, $$\overline{xm} = \frac{\sqrt{Ph^2 + 4P_v^2}}{4} = \frac{\sqrt{5}}{4}Ph = \frac{\sqrt{5}}{4}P_v \tag{3}$$

For example, if the printing pitches are equal both in the column and the row direction as is usual and the value thereof is 0.423 mm (1/60″), Ph=Pv=0.423 mm is substituted for equation (3) and xm=0.237 mm becomes the amount of movement.

Next, the movement of the printing end of the wire 108 during a short time will be considered in detail. The printing wire 108 at the point p is moved a distance B in the column direction, whereafter it begins to move toward the point m upon current supply to the guide driving device 124 and comes to the column direction position of the point m at a distance D short of the point m and at the moment when it has reached the point m while holding that position, it effects impact printing and at a position spaced apart by a distance E from the point m, the current to the guide driving device 124 is cut off and the printing wire begins to return toward the point n and, at a distance F from the point n, it returns to the column direction position of the point n and when it has reached the point n, it again effects printing. The reason why the printing wire 108 is caused to come onto the print line slightly short of the position whereat it is to print, as described above, is to provide a time allowance for eliminating the pernicious vibration of the printing wire 108 caused by the guide driving device 124 being electrically energized and abruptly stopped at the point m. It is also for the same reason that when the current supply to the guide driving device 124 is stopped and the wire printing end returns to the point n, the printing wire is caused to come to the print line of the point n slightly short of the point n. The operation of the printing wire 108 from after the printing at the point n till the printing at the point r is similar to that in the ordinary wire dot printer and therefore need not be described. Further, the printing steps at the points s and w will also be easily understood from the foregoing description made with respect to the points p, m and n.

Figure 10:
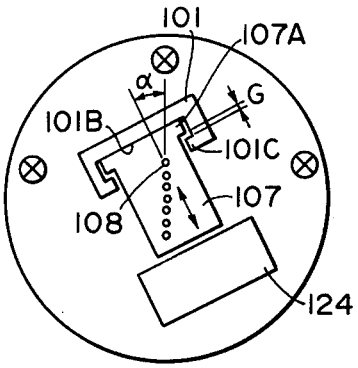
FIG. 10 is a schematic view of the equal speed moving print head according to the present invention, as seen from the platen side.

FIG. 10 is a schematic view of the print head described in connection with FIG. 9, as seen from the platen side. As shown, a projection 107A is provided on the upper portion of the guide 107 and projections 101C are provided on both sides of the stopper surface 101B of the body frame 101, so that when the guide driving device 124 is not operated (FIG. 10 shows this state), the projection 107A is urged against the stopper surface 101B by the plate spring 111 while, during the operation of the driving device 124, the projection 107A is urged against the projections 101C, thus determining the normal position and intermediate dot inserting position of the wire printing end side guide 107. By adopting such a construction, the clearance G between the projections 101C and 107A is determined inexpensively and highly accurately, Of course, the present invention can be carried out even in a case where the movement of the print head is neither equal speed movement nor intermittent movement, a case where the wire arrangement is not a row, or a case where the direction of wire arrangement has an inclination with respect to the printing row direction.

In the above-described printer, the mass of the print head itself is at least 50 g and generally, a head having seven to nine wires is of the order of 100–200 g. However, of the print head, only the printing end side guide (bearing portion) of the wire, if light in weight, is 0.5 g or less. Also, the usual dot pitch is of the order of 0.42 mm (1/60") and where a dot is inserted intermediate the conventional dots for the purpose of improving the printing quality, the guide of the wire may be moved by about 0.21 mm. Even if the number of wires is reduced down to one half of that in the prior art and the same dot matrix printing as the conventional one is effected by these wires, the amount of movement of the guide will be of the order of 0.42 mm. In any case, if the object to be moved is the wire printing end guide and if the guide has such degree of mass and is to be moved over such degree of amount, there will be no technical difficulty in moving the guide within a time of 1.6 ms. If only one dot is to be inserted intermediate the conventional dot positions as in the above-described example, it may be simply realized by using an electromagnet as the driving means. Particularly, where it is desired to insert two dots between the conventional dot positions to obtain a high quality of printing, use may be made of a voice coil motor. If lapse of more or less time is allowed, a step motor may also be used. The guide driving means is provided on the print head itself near the guide. The carriage is moved in the column direction and therefore, increased dot density in the column direction is achieved by simply shortening the impacting period or decreasing the movement speed of the carriage and thus, the present invention is usually directed to increased dot density in the row direction.

According to the present invention, as has hitherto been described, there is obtained the effect that a high quality of printing having a short inter-dot pitch can be realized relatively simply and inexpensively in the dot matrix incremental printing system.

What I claim is:

1. A printer, comprising:

a plurality of print wires arranged in a first direction;

support means for supporting said plurality of print wires;

guide means for guiding said plurality of print wires for movement in a print direction, said guide means being held by an elastic member including a magnetizable material and having one end supported by said support means; and means for causing said guide means to move in a second direction different from the first direction, said means for causing movement including magnetic means.

2. A printer according to claim 1, wherein said elastic member is a plate spring.

3. A printer according to claim 1, further comprising means for altering the position of said means for causing movement to adjust the amount of movement of said guide means.

4. A printer according to claim 2, wherein said means for causing movement is held together with said plate spring by said supporting means.

5. A printer according to claim 1, wherein said means for causing movement is held by said supporting means.

* * * * *

UNITED STATES PATENT AND TRADEMARK OFFICE

CERTIFICATE OF CORRECTION

PATENT NO. : 4,459,051

DATED : July 10, 1984

INVENTOR(S) : YASUO KAWAI

It is certified that error appears in the above-identified patent and that said Letters Patent is hereby corrected as shown below:

Column 5, line 11, after "wire" insert --print head is not at an equal speed, or a case where the wire--.

Column 6, line 1, change "when" to --When--.

Signed and Sealed this

*Nineteenth* Day of *March 1985*

[SEAL]

*Attest:*

DONALD J. QUIGG

*Attesting Officer* *Acting Commissioner of Patents and Trademarks*